US007686710B2

(12) United States Patent
Leiber et al.

(10) Patent No.: US 7,686,710 B2
(45) Date of Patent: Mar. 30, 2010

(54) GOLF DIVOT REPAIR TOOL

(76) Inventors: Mitchell J. Leiber, 7435 E. Corrine Rd., Scottsdale, AZ (US) 85260; Ortenzio M. A. Sticca, Jr., 18202 N. 30$^{th}$ La., Phoenix, AZ (US) 85053

( * ) Notice: Subject to any disclaimer, the term of this patent is extended or adjusted under 35 U.S.C. 154(b) by 12 days.

(21) Appl. No.: 11/974,765

(22) Filed: Oct. 16, 2007

(65) Prior Publication Data

US 2009/0098952 A1 Apr. 16, 2009

(51) Int. Cl.
*A63B 57/00* (2006.01)

(52) U.S. Cl. ..... 473/408

(58) Field of Classification Search ..... 473/408, 473/286; 30/151, 162, 163
See application file for complete search history.

(56) References Cited

U.S. PATENT DOCUMENTS 845,792 A * 3/1907 Jenkins ..... 30/162
3,360,807 A * 1/1968 Mauck ..... 30/169
3,539,017 A * 11/1970 Johnson ..... 473/408
5,388,824 A * 2/1995 Reimers ..... 473/408
5,449,169 A * 9/1995 Hardin et al. ..... 473/408
6,217,465 B1 * 4/2001 Kenia, Jr. ..... 473/408
6,413,173 B1 * 7/2002 Muller et al. ..... 473/408
6,413,174 B1 * 7/2002 Roberts ..... 473/408
6,428,430 B1 * 8/2002 Chong ..... 473/408
6,620,062 B2 * 9/2003 Taylor et al. ..... 473/408
6,837,807 B1 * 1/2005 Kerr ..... 473/408
7,238,125 B2 * 7/2007 Dymling ..... 473/408
7,305,769 B2 * 12/2007 McHenry et al. ..... 30/162

* cited by examiner

*Primary Examiner*—Steven Wong
(74) *Attorney, Agent, or Firm*—Tod R. Nissle, P.C.

(57) ABSTRACT

A golf repair tool includes a pivot repair member movable between a stored and a deployed position, and includes a spring assist construct that facilitates movement from the stored to the deployed position, and vice-versa.

1 Claim, 11 Drawing Sheets

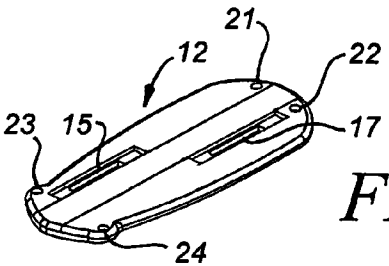
FIG. 6
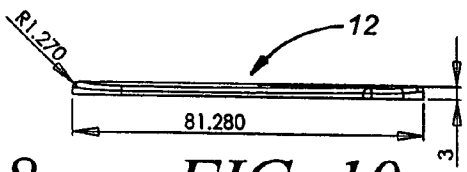
FIG. 10
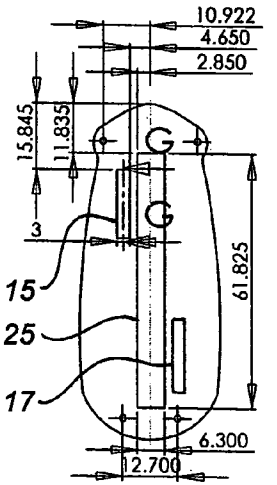
FIG. 7
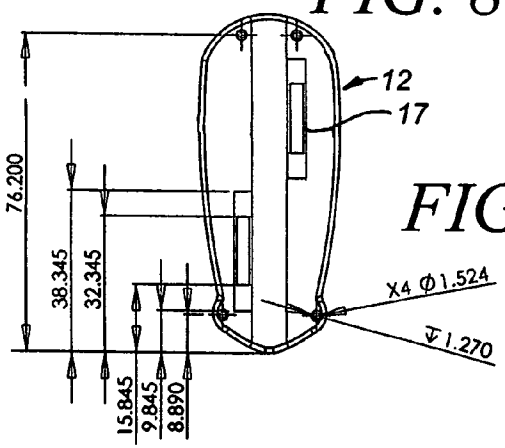
FIG. 9
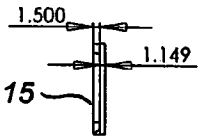
SECTION G-G
SCALE 1 : 1
FIG. 11
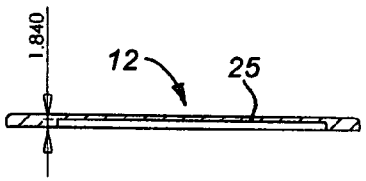
FIG. 12
FIG. 8

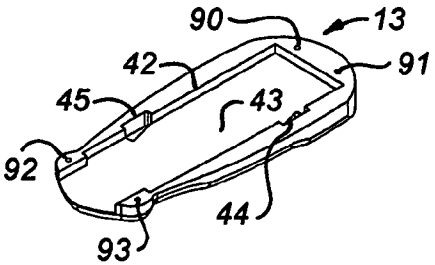
FIG. 16
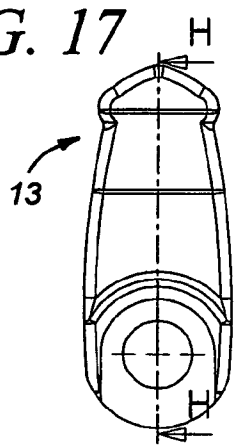
FIG. 17
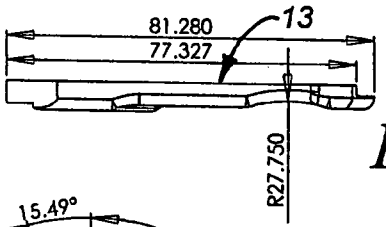
FIG. 20
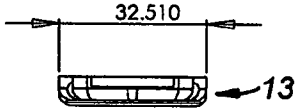
FIG. 18
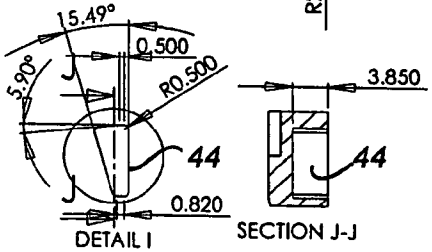
FIG. 23
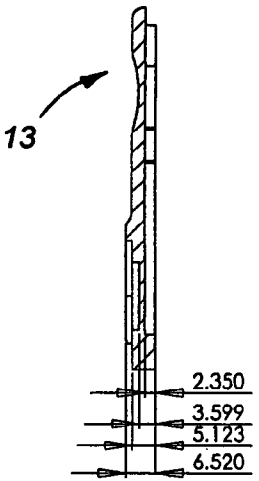
FIG. 21
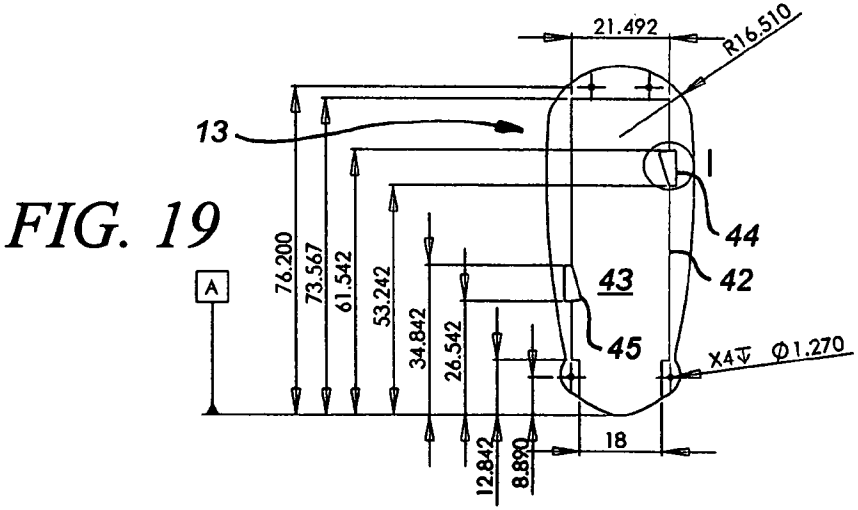
FIG. 19
FIG. 22

FIG. 30
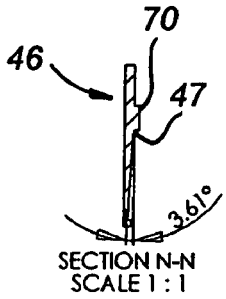
FIG. 25
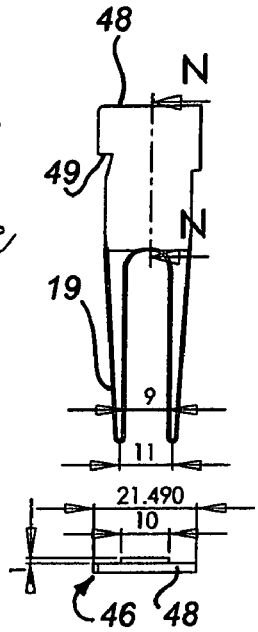
FIG. 24
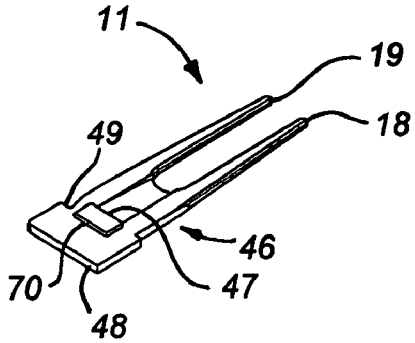
FIG. 26
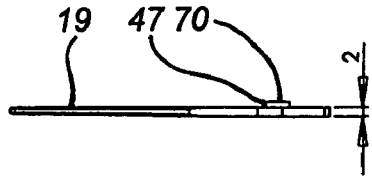
FIG. 29
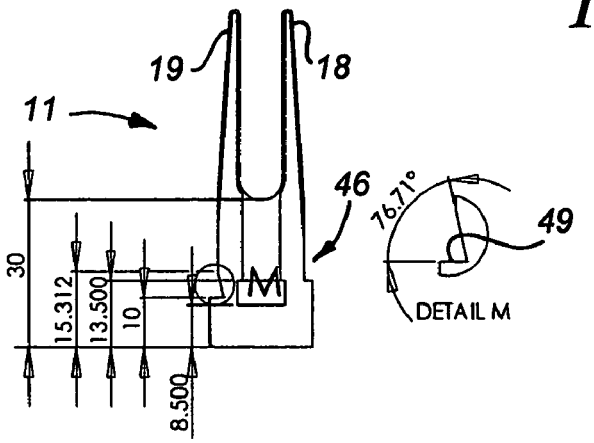
FIG. 28
FIG. 27

FIG. 31
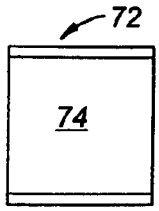
FIG. 31A
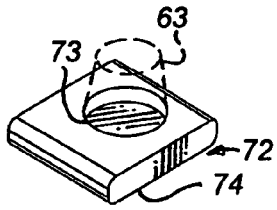
FIG. 32
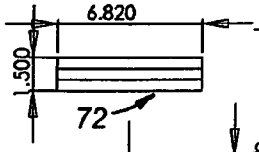
FIG. 34
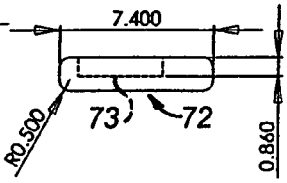
FIG. 33
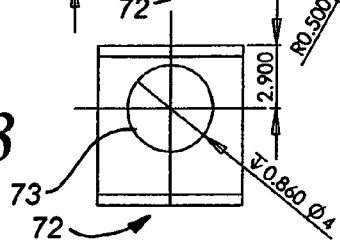
FIG. 35
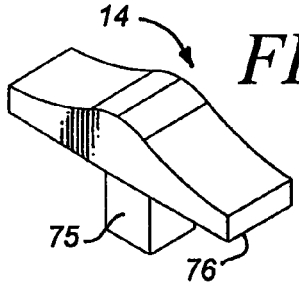
FIG. 36
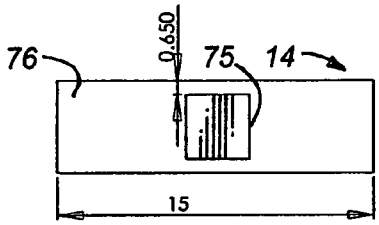
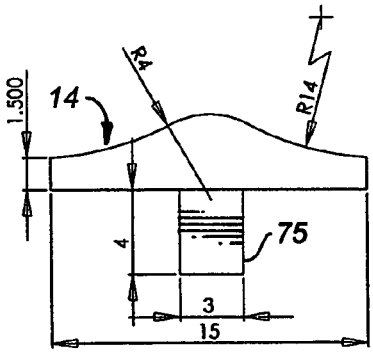
FIG. 37
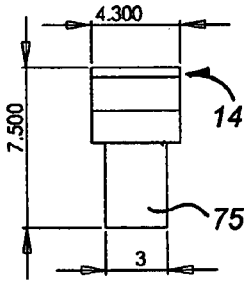
FIG. 38

FIG. 40
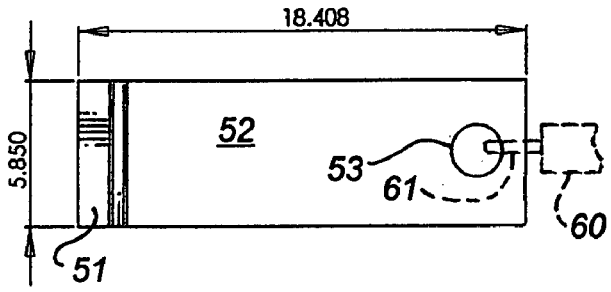
FIG. 39
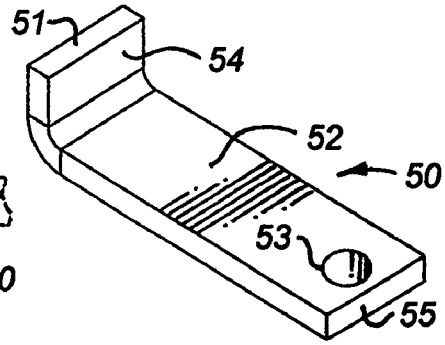
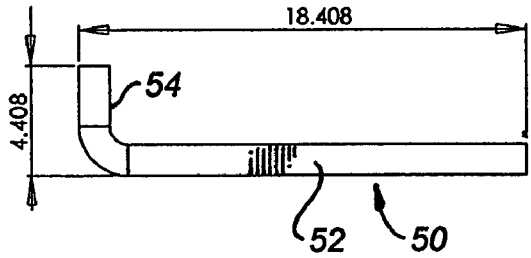
FIG. 41
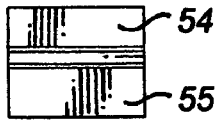
FIG. 42

GOLF DIVOT REPAIR TOOL

This application does not claims priority based on any earlier filed patent application.

This application pertains to tools utilized in the game of golf.

More particularly, the application pertains to tools utilized to repair divot ball marks on a green on a golf course.

A variety of tools are known for repairing divot marks on a green on a golf course. One general type of divot repair tool includes a housing and a divot repair member that is stored inside the housing. After the divot repair member is deployed, a spring assists movement of the double-pronged member from the deployed position back to the stored position inside the housing. The spring opposes movement of the double-pronged member from the stored to the deployed position. Such types of divot repair tools have long existed. There does not appear to be market pressure to change the design of such tools, nor does there appear to be any recognition of a design need that would fuel a search for a change in design of such golf divot tools. The market trend appears to be in favor of retaining such golf divot tools. As a result, it is anticipated that prior patents or articles describing such prior art golf divot tools will not discuss market pressure or a design need in connection with the spring assist in divot tools.

In addition, the knowledge of a skilled artisan appears to comprise the divot tools noted above. Consequently, there does not seem to be motivation for the artisan to consider altering such tools.

However, as has been demonstrated many times in the Patent Office, existing apparatus and methods often can be improved by utilizing an unidentified, unanticipated combination which provides functions that are unpredictable in view of the prior art.

Accordingly, it would be highly desirable to provide an improved spring assisted golf divot repair tool.

Therefore, it is a principal object of the invention to provide an improved golf divot repair tool.

A further object of the invention is to provide an improved golf divot repair tool in which movement from the stored to the deployed position, and vice-versa, is spring assisted to facilitate use of the tool by youngsters and by older golfers with limited strength in their hands.

These and other, further and more specific objects and advantages of the invention will be apparent from the following detailed description thereof, taken in conjunction with the drawings, in which:

FIG. 6 is a perspective view illustrating the top plate of the housing of the divot repair tool of FIG. 1:

FIG. 7 is a bottom view further illustrating the top housing plate of FIG. 6;

Figure 13:
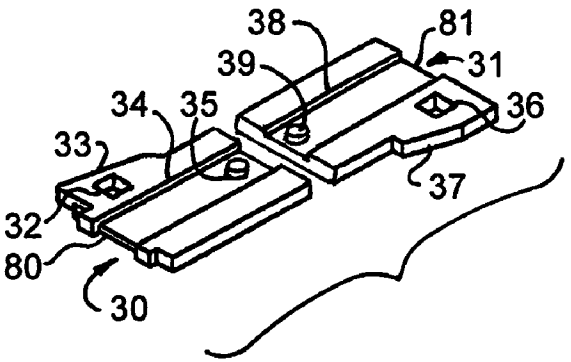
Figure 14:
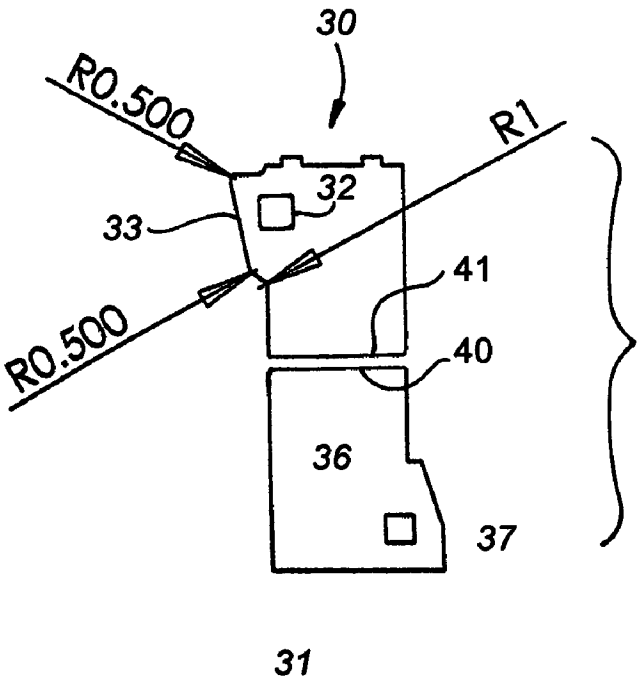
Figure 15:
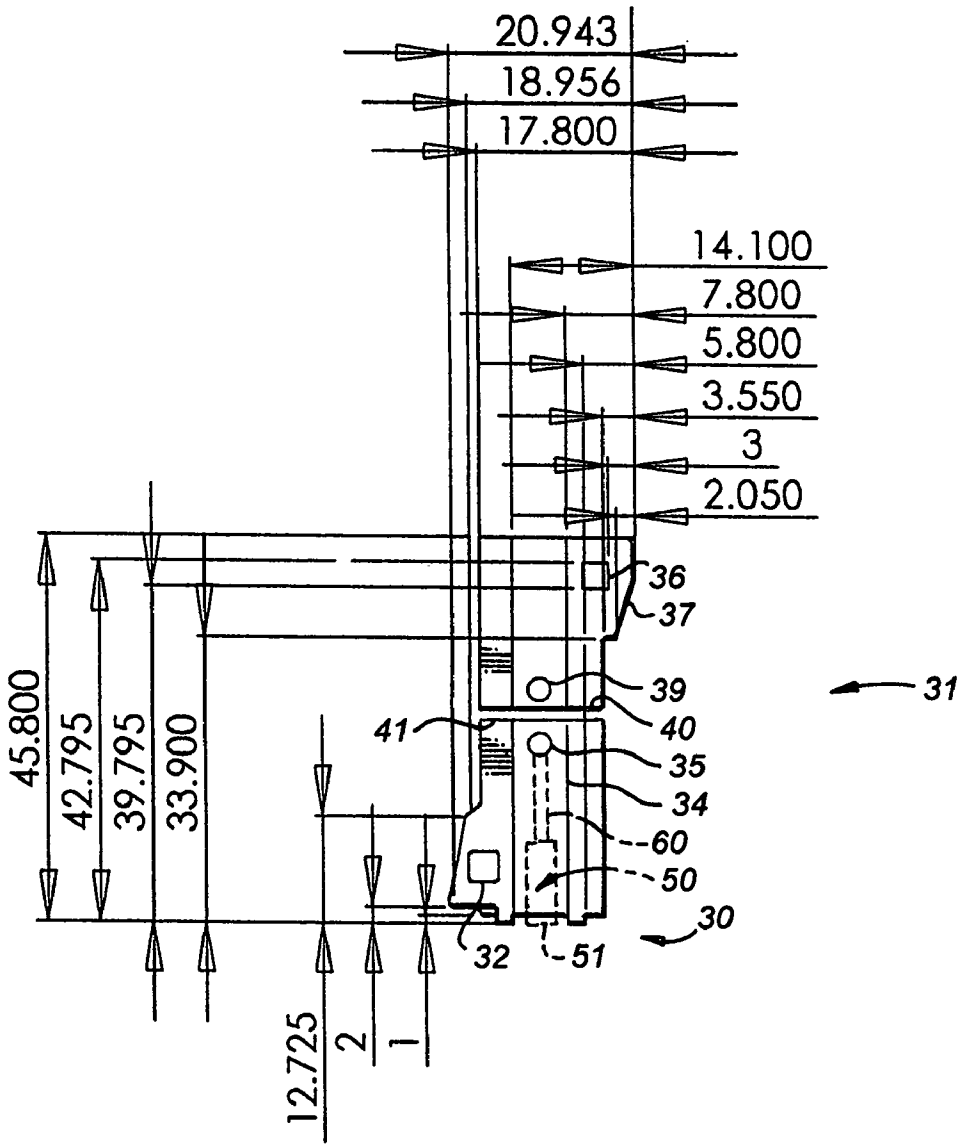
Figures 43, 44, 45, 46, 47, 48, 49, 50, 51, 52, 53:
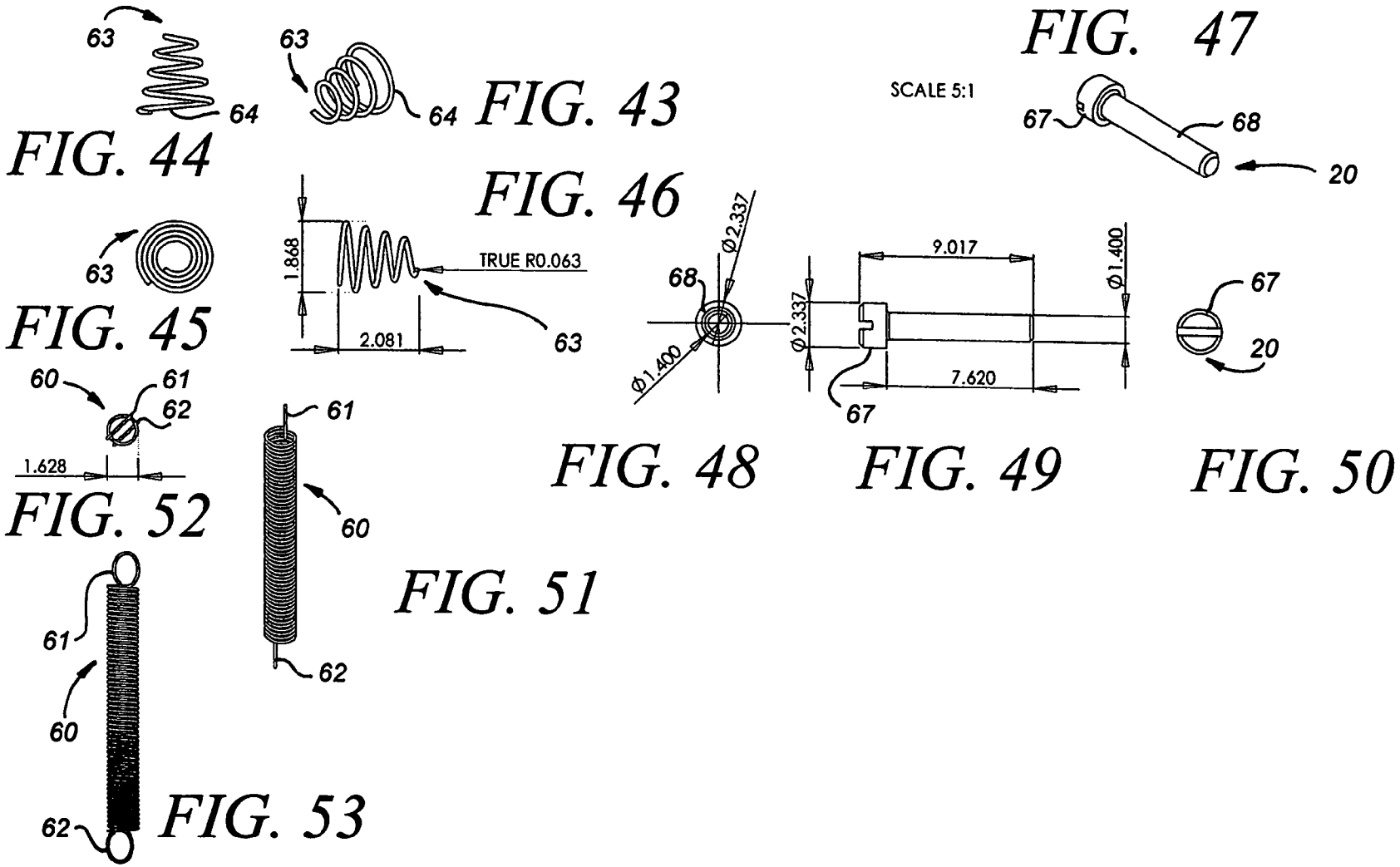
Figure 54:
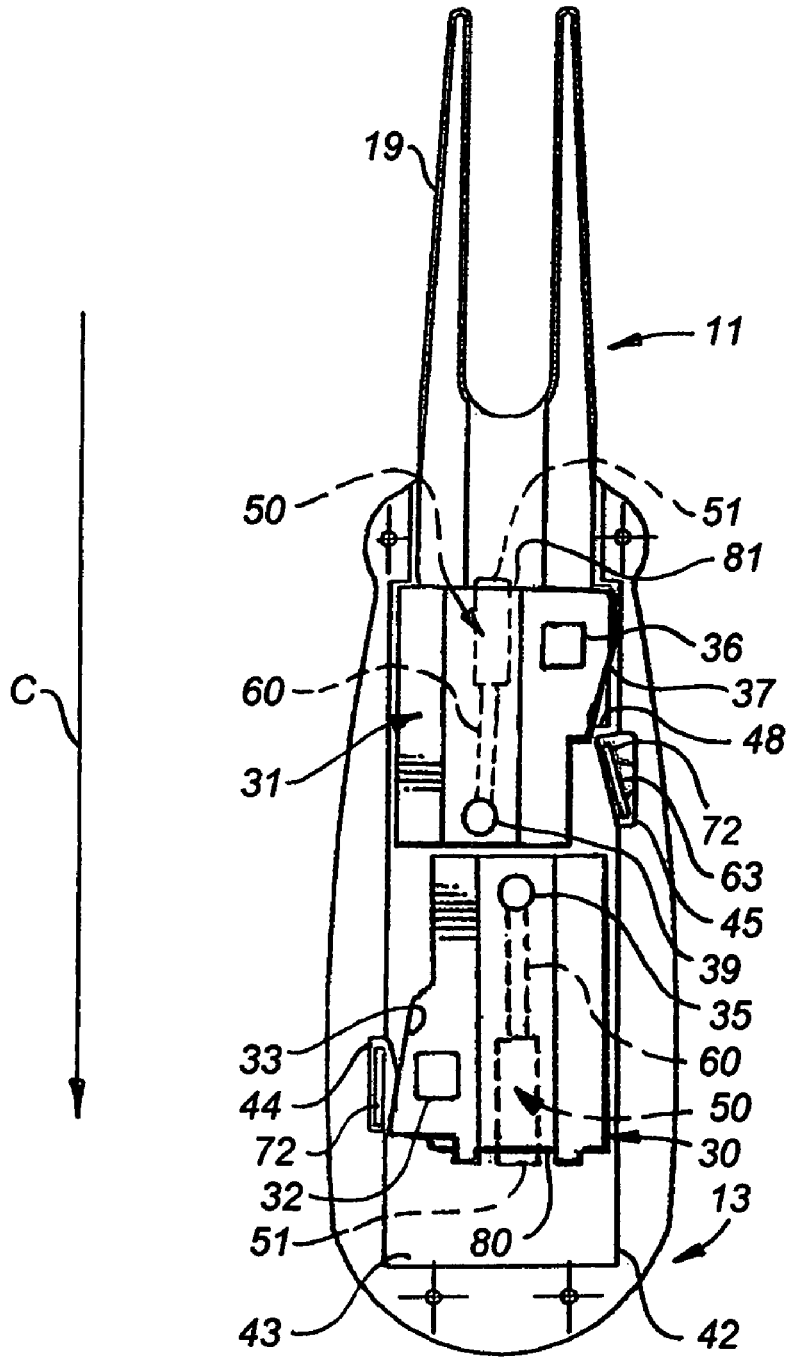
Figure 55:
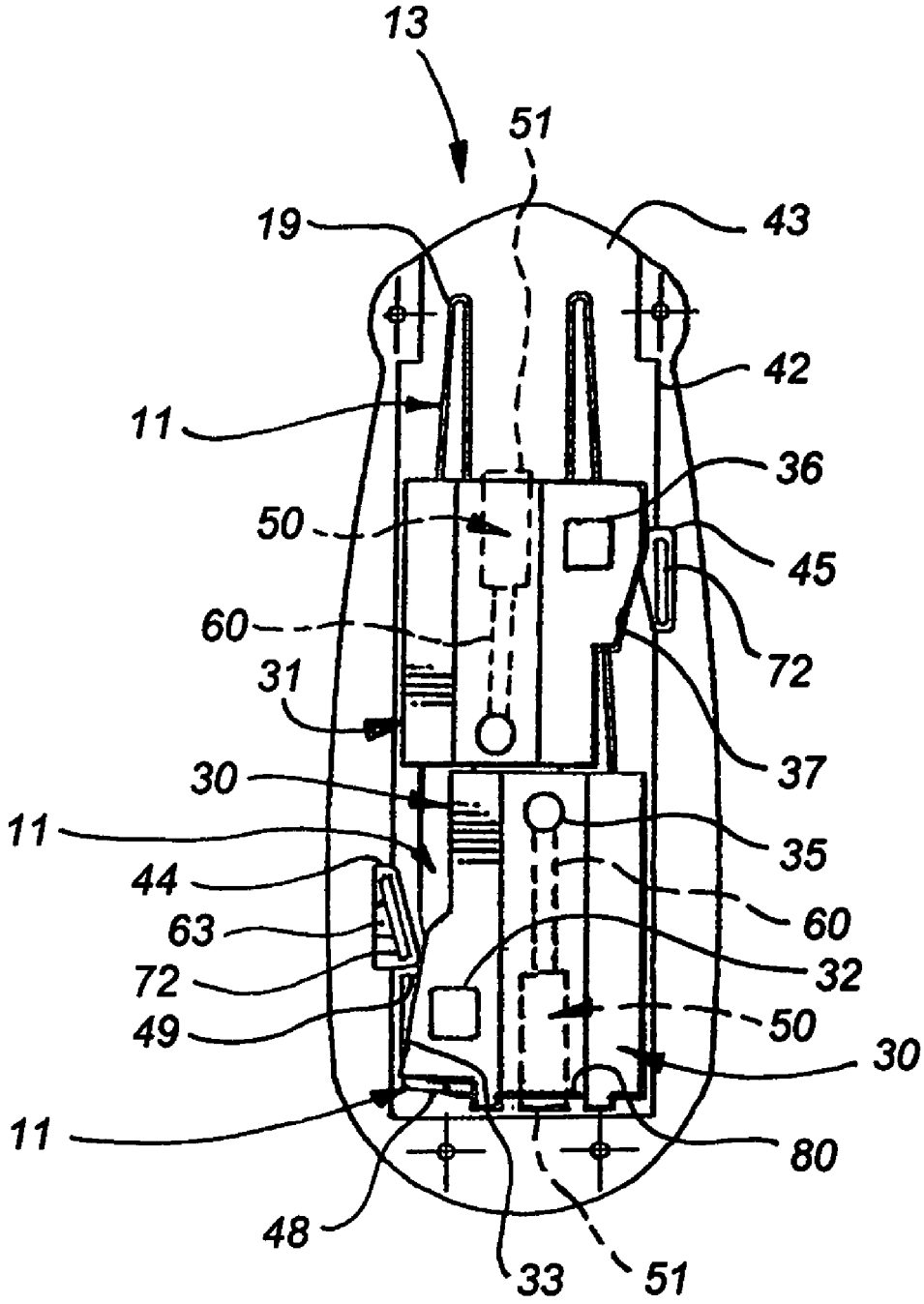

FIG. 8 a left hand end view illustrating the plate of FIG. 6;

FIG. 9 is a top view illustrating the plate of FIG. 6;

FIG. 10 is a side view illustrating the plate of FIG. 6;

FIG. 11 is a section view illustrating a slot formed in the plate of FIG. 6 to receive slidably a slide that comprises a portion of the control unit of the divot repair tool of the invention;

FIG. 12 is a section view illustrating a detent formed in the underside of the plate of FIG. 6 to provide space for and receive in part springs and L-shaped engagement fingers comprising a portion of the control unit of the divot repair tool of the invention;

FIG. 13 is a composite perspective view illustrating two operative members comprising a portion of the control unit of the divot repair tool of the invention, which members slide intermediate the top housing plate and the green manipulating member of the divot repair tool of the invention;

FIG. 14 is a bottom view illustrating the operative members of FIG. 13;

FIG. 15 is a top view illustrating the operative members of FIG. 13;

FIG. 16 is a perspective view illustrating the bottom plate of the housing of the divot repair tool of the invention;

FIG. 17 is a bottom view illustrating the plate of FIG. 16, including a portion thereof shaped and dimensioned and formed to receive slidably a circular ball marker;

FIG. 18 is a left hand end view illustrating the plate of FIG. 16;

FIG. 19 is a top view illustrating the plate of FIG. 16;

FIG. 20 is a back side view illustrating the plate of FIG. 16;

FIG. 21 is a section view of the plate of FIG. 16 taken along section line H-H and further illustrating construction details of the plate;

FIG. 22 is a top view illustrating a detent formed in the plate of FIG. 16 to receive and house a spring operating latch plate;

FIG. 23 is a section view of the detent of FIG. 22 illustrating further construction details thereof;

FIG. 24 is a perspective view illustrating the green-manipulating member of the divot repair tool of the invention;

FIG. 25 is a bottom view illustrating the green-manipulating member of the divot repair tool of the invention;

FIG. 26 is a left hand end view illustrating the member of FIG. 24;

FIG. 27 is a top view illustrating the member of FIG. 24;

FIG. 28 is a detail view illustrating a notch in the member of FIG. 24 that periodically releasably engages a spring loaded latch plate during operation of the divot repair tool of the invention;

FIG. 29 is a back side view illustrating the member of FIG. 24;

FIG. 30 is a section view of the base of the member of FIG. 24 illustrating further construction details thereof;

FIG. 31A is a perspective view illustrating a latch plate that is utilized in conjunction with a spring to control the position of the green-manipulating member in the divot repair tool of the invention;

FIG. 31 is a bottom view illustrating the latch plate of FIG. 30;

FIG. 32 is a left hand end view illustrating the latch plate of FIG. 30;

FIG. 33 is a top view illustrating the latch plate of FIG. 30;

FIG. 34 is a back side view illustrating the latch plate of FIG. 30;

FIG. 35 is a perspective view illustrating a slide utilized in the control unit of the divot repair tool of the invention;

FIG. 36 is a bottom view illustrating the slide of FIG. 35;

FIG. 37 is a left hand side view illustrating the slide of FIG. 35;

FIG. 38 is an end view illustrating the slide of FIG. 35;

FIG. 39 is a perspective view illustrating a L-shaped finger utilized in the control unit of the divot repair tool of the invention;

FIG. 40 is a top view illustrating the L-shaped finger of FIG. 39;

FIG. 41 is a side view illustrating the L-shaped finger of FIG. 39;

FIG. 42 is a right hand end view illustrating the L-shaped finger of FIG. 39;

FIG. 43 is a perspective view illustrating a spring utilized with the latch plate of FIG. 30;

FIG. 44 is a side view illustrating the spring of FIG. 43;

FIG. 45 is a top view illustrating the spring of FIG. 43;

FIG. 46 is a side view illustrating the spring of FIG. 34;

FIG. 47 is a perspective view illustrating a bolt utilized to connect and secure together the top and bottom housing plates with the green-manipulating member and the operative members sandwiched and housed therebetween;

FIG. 48 is a right hand end view illustrating the bolt of FIG. 47;

FIG. 49 is a side view illustrating the bolt of FIG. 47;

FIG. 50 is a left hand end view illustrating the bolt of FIG. 47;

FIG. 51 is a perspective view illustrating a spring that is connected at one end to the L-shaped finger of FIG. 39 and at the other end to an upstanding post or dimple of one of the operative members illustrated in FIG. 13;

FIG. 52 is a top view illustrating the spring of FIG. 51;

FIG. 53 is a side view illustrating the spring of FIG. 51;

FIG. 54 is a top view of a partially assembled divot repair tool illustrating the mode of operation thereof; and, FIG. 55 is a top view of a partially assembled divot repair tool illustrating the mode of operation thereof.

Briefly, in accordance with the invention, I provide a golf divot repair tool comprising a housing including at least one slot formed therein; and, a golf green-manipulating member comprising a base; a pair of spaced apart prongs attached to and extending from the base; a first contact edge on the base; and, a second contact edge on the base spaced apart from the first contact edge. The green-manipulating member is mounted in the housing for movement between at least two operative positions, a stowed position inside the housing, and a deployed position with the prongs extending away from the housing. The tool also includes a control unit mounted in the housing and including at least one operative member slidably mounted adjacent the green-manipulating member; a L-shaped member extending outwardly from the operative member and contacting one of the contact edges on the base of the green-manipulating member; a spring interconnecting the operative member and the L-shaped member; and, a slide mounted on the housing and extending through the slot to the operative member. The slide is manually slidably displaceable along the slot to displace slidably the operative member of the control unit to tension and extend the spring to generate a force on the L-shaped member that slidably displaces the operative member and displaces the green-manipulating member from the stowed to the deployed position.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 5 illustrate a fully assembly divot repair tool generally indicated by reference character 10 and including a top housing plate 12, a bottom housing plate 13, a green-manipulating member 11, and slides 14 and 16. Slots 15 and 17 are formed through top housing plate 12 each to slidably receive the foot 75 (FIG. 35) of a slide 14, 16 extending therethrough. Slide 14 is illustrated in more detail in FIGS. 35 to 38. Slide 16 is identical in shape and dimension to slide 14. The foot 75 of each slide extends through a slot 15, 17 and into an aperture 32, 36 formed in one of the operative members 30, 31, respectively. Consequently, when a slide 14, 16 is slidably moved along a slot 15, 17 in one of the directions indicated by arrows B (FIG. 1), its associated operative member 30, 31 moves simultaneously with the slide 14, 16. Green-manipulating member 11 includes spaced apart prongs 18, 19.

Top housing plate 12 is illustrated in more detail in FIGS. 6 to 12 and includes apertures 21, 22, 23, 24 formed therein to receive externally threaded bolts 20 (FIG. 47). When the divot repair tool is assembled, each aperture 21 to 24 of the top plate 12 is in registration with an aperture 90 to 93 of the bottom plate 13 such that each bolt 20 threads through an aperture 21 to 24 and into one of the apertures 90 to 93.

Operative members 30 and 31 are illustrated in FIGS. 13 to 15. Operative member 31 includes square aperture 36 formed therethrough, includes contact or cam edge 37, includes detent or groove 38, includes post 39 depending upwardly from the bottom of groove 38, includes leading edge 81 at one end of groove 38, and includes leading edge 40 (FIG. 15) at the other end of member 31.

An L-shaped finger 50 is mounted on operative member 31 such that leg 52 (FIG. 39) is seated in groove 38 and leg 51 extends downwardly over and past leading edge 81 such that contact surface 54 can contact leading edge surface 47 on green-manipulating member 11 (FIG. 24). Member 11 is positioned beneath operative members 30, 31. Surface 54 of finger 50 is pulled against and held in position against edge 81 by spring 60 which extends from finger 50 to post 39. As is illustrated in FIG. 41, one end 61 of spring 60 extends through aperture 53 formed in L-shaped finger 50. Although not visible in the drawings, the other end 62 of spring 60 engages post 39. Consequently, a finger 50 and spring 60 are positioned on operative member 31 in the manner illustrated in FIGS. 54 and 55. Spring 60 is tensioned between post 39 and finger 50.

Figure 2:
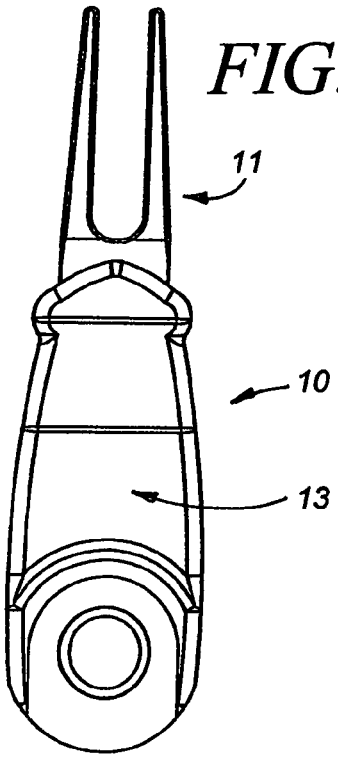
FIG. 2 is a bottom view illustrating the divot repair tool of FIG. 1.
Figure 1:
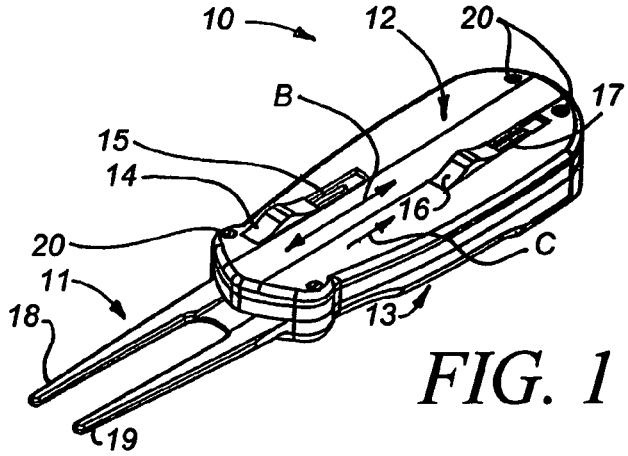
FIG. 1 is a perspective view illustrating the divot repair tool of the invention.
Figure 5:
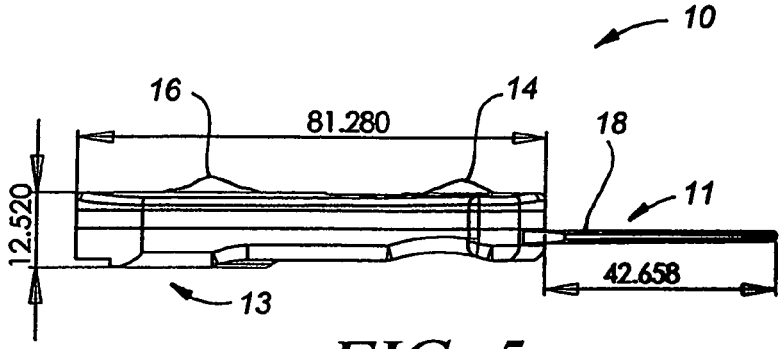
FIG. 5 is a side view illustrating the divot repair tool of FIG. 1.
Figure 4:
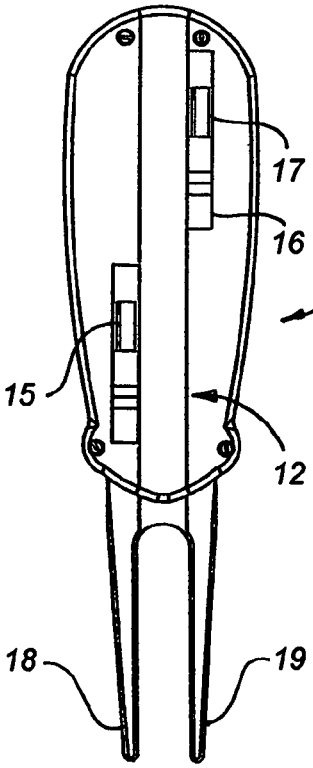
FIG. 4 is a top view illustrating the divot repair tool of FIG. 1.
Figure 3:
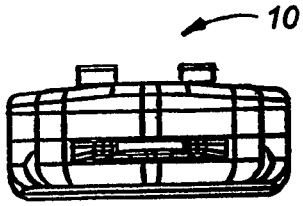
FIG. 3 is a left hand end view illustrating the divot repair tool of FIG. 1 and viewing said tool from the "dual prong end" thereof.

The foot 75 of slide 14 extends into aperture 36 of operative member 31 so that, as earlier noted, when slide 14 is manually slid along slot 15 in a direction indicated by arrows B in FIG. 1, foot 75 simultaneously slides operative member 31 in the same direction.

Operative member 30 is similar in shape to member 31 and includes square aperture 32 formed therethrough, includes contact or cam edge 33, includes detent or groove 34, includes post 35 depending upwardly from the bottom of groove 34, including leading edge 80 at one end of groove 34, and includes leading edge 41 (FIG. 15) at the other end of member 30.

An L-shaped finger 50 is mounted on operative member 30 such that leg 52 (FIG. 39) is seated in groove 38 and leg 51 extends downwardly over and past leading edge 80 such that contact surface 54 can contact leading edge surface 48 on the back of the base 46 of green-manipulating member 11 (FIG. 24). Surface 54 of finger 50 is pulled against and held in position against edge 80 by spring 60 which extends from finger 50 to post 35. As is illustrated in FIG. 41, one end 61 of spring 60 extends through aperture 53 formed in L-shaped finger 50. Although not visible in the drawings, the other end 62 of spring 60 engages post 35. Consequently, a finger 50 and spring 60 are positioned on operative member 31 in the manner illustrated in FIGS. 15, 54 and 55. Spring 60 is tensioned between post 35 and finger 50.

The square foot 75 of slide 16 extends into square aperture 32 of operative member 30 so that, as earlier noted, when slide 16 is manually slid along slot 17 in a direction indicated by arrows B in FIG. 1, foot 75 simultaneously slides operative member 30 in the same direction.

The bottom plate 13 of the housing of the divot repair tool of the invention is illustrated in more detail in FIGS. 16 to 23. Pie-shaped openings 44, 45 formed in plate 13 each receive a latch plate 72 (FIG. 30) and its associated spring 63 in the manner illustrated in FIGS. 54 and 55. The latch plates 72 are, as will be described, operated by operative members 30 and 31 and the contact surfaces 33 and 37 formed thereon. Detent or slot 42 is formed in plate 13 and includes bottom 43.

When the divot repair tool of the invention is assembled, the green-manipulating member 11 is placed on bottom 43 of slot 42 and, during operation of the divot repair tool, slides to and fro along bottom 43 between a deployed and a stowed position. Further, when the divot repair tool is assembled, the operative members 30 and 31 are placed on top of green-manipulating member 11 to slide therealong during operation of the tool, after which the top plate 12 is positioned on the bottom plate 13 with apertures 21 to 24 in the top plate 12 each in registration with an aperture 90 to 93 in the bottom plate 13. Four bolts 20 are utilized to secure the top to the bottom plate, each bolt 20 extending through a different one of apertures 21 to 24 and its associated aperture 90 to 93 in bottom plate 13. Accordingly, when the divot repair tool is assembled, the green-manipulating member 11 and the operative members 30 and 31 are slidably sandwiched between the top plate 12 and the bottom plate 13.

The green-manipulating member 11 is illustrated in more detail in FIGS. 24 to 30. Dual prongs 18, 19 outwardly depend from base 46. Base 46 includes leading edge surface 48 at the back of member 11 and includes outwardly extending orthogonal platform or post 79. Orthogonal platform 79 includes leading edge surface 47. As earlier described, a portion of contact surface 54 of leg 51 of L-shaped finger 50 mounted on operative member 31 extends downwardly from member 31 and can engage leading edge surface 47. And, a portion of contact surface 54 of leg 51 of L-shaped finger mounted on operative member 30 extends downwardly from member 30 and can engage leading edge surface 48.

Member 11 also includes notch 49. Notch 49 is, as will be described, periodically engaged by a latch plate 72 in order to maintain member 11 in the stowed position inside the housing of the divot repair tool. Similarly, leading edge surface 48 is periodically engaged by another of the latch plates 72 in order to maintain member 11 in the deployed position with the dual prongs 18, 19 extending outwardly from the housing of the divot repair tool.

A latch plate 72 is illustrated in more detail in FIGS. 30 to 34 and includes a recess, or detent, 73 that receives the bottom 64 of conical spring 63.

Slider 14 is illustrated in more detail in FIGS. 35 to 38 and includes orthogonal foot 75 that extends through a slot 15, 17 and into an aperture 32, 36 of an operative member 30, 31.

L-shaped finger 50 is illustrated in more detail in FIGS. 39 to 42 and includes leg 51, contact surface 54, leg 52, end 55, and aperture 53 formed through leg 52.

Conical spring 63 is illustrated in more detail in FIGS. 43 to 46 and includes bottom 64.

Elongate cylindrical spring 60 is illustrated in more detail in FIGS. 51 to 53 and includes ends 61 and 62.

Bolt 20 is illustrated in more detail in FIGS. 47 to 50 and includes slotted head 67, and body 68. Body 68 is externally threaded (not shown) in a conventional manner.

The operation of the divot repair tool of the invention is described with reference to FIGS. 54 and 55. In FIG. 54, the top plate 12 and sliders 14, 16 are, for sake of clarity, omitted.

In FIG. 54, the green-manipulating member 11 is in the deployed position. The position of member 11 and of operative members 30 and 31 in FIG. 54 is equivalent to that of members 11, 30, 31 in the tool 10 illustrated in FIG. 1. Consequently, when operative members 30 and 31 are in the position illustrated in FIG. 54, sliders 14 and 16 are in the positions shown in FIG. 1.

In FIG. 54, the latch plate 72 in detent 45 is pushed, or canted, inwardly by its associated spring 63. Latch plate 72 in detent 45 can move to this inwardly canted position because operative member 31 is in a forward position in detent 42 of the bottom plate 13. When operative member 31 is in a forward position, contact edge 37 does not interfere with, or block movement of plate 72 in detent 45. When latch plate 72 in detent 45 is in the position illustrated in FIG. 54, it prevent the leading edge surface 48 at the back of member 11 from moving rearwardly in a direction toward detent 44, and, accordingly, maintains member 11 in the deployed position illustrated in FIG. 54. In FIG. 54, the latch plate 72 in detent 44 is not able to be moved by its associated spring 63 to an inwardly canted position comparable to that of latch plate 72 in detent 45. Such movement by latch plate 72 in detent 44 is prevented by the cam surface 33 of operative member 30.

In FIG. 54, leg 51 of the finger 50 mounted on operative member 30 extends downwardly from member 30 but contact surface, 54 of leg 51 does not engage the leading edge surface 48 of member 11. In contrast, leg 51 of the finger 50 mounted on operative member 31 extends downwardly from member 31 and contact surface 54 of leg 51 does contact and is spaced apart from leading edge surface 47 of member 11.

The following procedure is utilized to move member 11 from the deployed position of FIG. 54 to the stowed position of FIG. 55.

First, slide 16 is moved from the position shown in FIG. 1 rearwardly in the direction of arrow C in FIGS. 1 and 54 until operative member 30 has moved rearwardly to the position illustrated in FIG. 55. This permits the latch plate 72 in detent 44 to move temporarily to an inwardly canted position comparable to that shown for latch 72 in detent 45 in FIG. 55.

Second, slide 14 is moved from the position shown in FIG. 1 rearwardly in the direction of arrow C in FIGS. 1 and 54 until operative member 31 has moved rearwardly to the position shown in FIG. 55. When operative member 31 moves in the direction of arrow C, cam surface 37 of member 31 slides over latch plate 37 and forces it outwardly back into detent 45 to the position shown in FIG. 55, while at the same time the movement of post 39 (and member 31) temporarily stretches and further tensions spring 60 on member 31. Spring 60 on member 31 is temporarily stretched because (1) latch plate 72 contacts leading edge surface 48 at the back of member 11 and prevents member 11 from moving in the direction of arrow C, and (2) since contact surface 54 of leg 51 is engaging that stationary leading edge surface 47 on member 11, L-shaped finger 50 is prevented from moving. In other words, since post 39 is moving away from stationary finger 50, spring 60 is stretched therebetween. When, however, cam surface 37 has sufficiently pushed latch plate 72 back into detent 45 to the position shown in FIG. 55, latch plate 72 no longer interferes with the movement of member 11 in the direction of arrow C, and tensioned spring 60 functions to pull, or catapult, member 11 from the deployed position of FIG. 54 to the stowed position of FIG. 55. Since contact surface 54 of L-shaped finger 50 on member 31 extends over contact edge surface 81 of member 31 and over contact edge surface 47 of platform 70 (FIG. 24) of member 11, tensioned spring 60 functions to pull (with finger 50 on member 31) both members 11 and 30 from the positions shown in FIG. 55 to the positions shown in FIG. 54.

When spring 60 pulls member 11 to the position shown in FIG. 55, the base 26 of member 11 initially forces latch plate 72 in detent 44 back to the position illustrated in FIG. 54. But, as soon as member 11 has catapulted or moved a distance rearwardly sufficient to bring notch 49 to the position illustrated in FIG. 55, the latch plate 72 in detent 44 is free to be moved by its associated spring 63 outwardly to the canted position illustrated in FIG. 55. In this position, latch plate 72 in detent 44 prevents member 11 from moving from the stowed position of FIG. 55 to the deployed position of FIG. 54.

In FIG. 55, leg 51 of the finger 50 mounted on operative member 30 extends downwardly from member 30 and contact surface 54 of leg 51 engages the leading edge surface 48 of member 11. In contrast, leg 51 of the finger 50 mounted on operative member 31 extends downwardly from member 31 and contact surface of leg 51 does not contact, and is spaced apart from, leading edge surface 47 of member 11.

When it is desired to move the green-manipulating member 11 from the stowed position of FIG. 55 to the deployed position of FIG. 54, slider 14 is moved forwardly back to the position illustrated in FIG. 1. This moves operative member 31 back to the position shown in FIG. 1. Slider 16 is then moved forwardly back to the position illustrated in FIG. 1. When slider 16 is moved forwardly, operative member 30 is moved back to the position shown in FIG. 1. When operative member 30 moves forwardly in a direction opposite that of arrow C, cam surface 33 of member 30 slides over latch plate 37 in detent 44 and forces it outwardly back into detent 45 to the position shown in FIG. 54, while at the same time the movement of post 35 (and member 30) temporarily stretches spring 60 on member 30. Spring 60 on member 31 is temporarily stretched because (1) latch plate 72 in detent 44 contacts notch 49 at the side of member 11 and prevents member 11 from moving in a direction opposite that of arrow C, and (2) since contact surface 54 of leg 51 is engaging that leading edge surface 48 at the back of member 11, L-shaped finger 50 is prevented from moving. In other words, since post 35 is moving away from stationary finger 50 mounted on member 30, spring 60 on member 30 is stretched therebetween.

When, however, cam surface 33 has sufficiently pushed latch plate 72 back into detent 44 to the position shown in FIG. 54, latch plate 72 no longer interferes with the movement of member 11, and tensioned spring 60 functions to pull, or catapult, member 11 from the stored position of FIG. 55 to the deployed position of FIG. 54. Since contact surface 54 of L-shaped finger 50 on member 30 extends over contact edge surface 80 of member 30 and over contact edge surface 48 of member 11, tensioned spring 60 functions to pull (with finger 50 on member 30) both members 11 and 30 from the positions shown in FIG. 55 to the positions shown in FIG. 54, and to catapult member 11 past detent 45 to the position shown in FIG. 54 such that spring-loaded latch 72 in detent 45 once again moves to the outwardly canted position shown in FIG. 54 and, by contacting edge surface 48 of member 11, prevents member 11 from moving from the deployed to the stowed position.

In another embodiment of the invention, operative members 30 and 31 are joined together in the orientation shown in FIGS. 13 to 15 to make a unitary operative member so that only a single slider 14, 16 is required.

Having described my invention in such terms as to enable those of skill in the art to understand and use it, and having described the presently preferred embodiments and best mode thereof, we claim:

1. A golf divot repair tool including (a) a housing including (i) a top housing plate (12) with at least one slot (15, 17) formed therein, and (ii) a bottom housing plate (13) including an elongate detent (42) with a bottom (43), and at least one pie-shaped opening (44, 45) adjacent said bottom (43);

(b) a golf green-manipulating member (11) having (i) a base, (ii) a pair of spaced apart prongs attached to and extending from said base, (iii) a first contact surface edge (47) on said base, (iv) a second contact surface edge (48) on said base spaced apart from said first contact edge, said member mounted in said housing for movement between at least two operative positions, (v) a stowed position inside said housing, and (vi) a deployed position with said prongs extending away from said housing;

(c) a control unit slidably mounted in said detent (42) in said housing, slidably contacting said bottom (43), and including (i) at least one operative member (30, 31) slidably mounted adjacent said green-manipulating member and including a third peripheral contact surface (37), (ii) a L-shaped member (50) including a leg (52) and a foot (51) extending outwardly from said leg (52) and contacting one of said contact edges (47, 48) on said base of said green-manipulating member, (iii) a spring (60) interconnecting said member (30, 31) and said leg (52) of said L-shaped member, and (iv) a slide (14, 16) mounted on said housing and extending through said slot to said operative member, said slide manually slidably displaceable along said slot to displace slidably said operative member (30, 31) of said control unit along said bottom (43) from a preliminary operative position to a secondary operative position to tension and extend said spring to generate a force on said L-shaped member that acts against said one of said contact edges on said base to slidably displace said operative body, and said green manipulating member from said stowed position to said deployed position; and, (d) a latch plate (72) pivotally mounted in said pie-shaped opening (44, 45);

(e) a compressed spring (63) mounted in said pie-shaped opening (44, 45), and contacting and operatively associated with said latch plate (72) and said pie-shaped opening to permit said latch plate to move between two operative positions, (i) a first operative position with said latch plate (72) inwardly displaced by said compressed spring (63) to contact said second contact surface edge (48) to maintain said member (11) in said deployed position, and (ii) a second operative position with said latch plate (72) outwardly displaced by said third contact surface (37) when said member (30, 31) is in said preliminary operative position to disengage said latch plate (72) from said second contact surface edge (48) and permit said member (11) to move from said deployed to said stowed position.

* * * * *